US010570547B2

(12) United States Patent
Lee

(10) Patent No.: US 10,570,547 B2
(45) Date of Patent: Feb. 25, 2020

(54) LAUNDRY TREATING APPARATUS

(71) Applicant: LG ELECTRONICS INC., Seoul (KR)

(72) Inventor: Sangyong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/271,756

(22) Filed: Sep. 21, 2016

(65) Prior Publication Data

US 2017/0088998 A1 Mar. 30, 2017

(30) Foreign Application Priority Data

Sep. 25, 2015 (KR) ..... 10-2015-0136397

(51) Int. Cl.

| | |
|---|---|
| ***D06F 37/26*** | (2006.01) |
| ***D06F 37/12*** | (2006.01) |
| ***D06F 39/00*** | (2006.01) |
| ***D06F 29/00*** | (2006.01) |
| *D06F 39/12* | (2006.01) |

(52) U.S. Cl.

CPC ..... *D06F 37/264* (2013.01); *D06F 29/00* (2013.01); *D06F 37/12* (2013.01); *D06F 39/001* (2013.01); *D06F 39/12* (2013.01)

(58) Field of Classification Search

None

See application file for complete search history.

(56) References Cited

U.S. PATENT DOCUMENTS

| | | | | |
|---|---|---|---|---|
| 3,184,048 | A | 5/1965 | Bjerum | |
| 3,812,959 | A | 5/1974 | Brennan | |
| 3,904,039 | A * | 9/1975 | Anyon ..... | B65D 81/1075 206/320 |
| 3,912,076 | A | 10/1975 | Elwell | |
| 4,366,902 | A | 1/1983 | Fanson et al. | |
| 5,934,107 | A | 8/1999 | Lee et al. | |

(Continued)

FOREIGN PATENT DOCUMENTS

| | | |
|---|---|---|
| CN | 101451295 | 6/2009 |
| CN | 203652245 | 6/2014 |

(Continued)

OTHER PUBLICATIONS

Extended European Search Report issued in European Application No. 16187109.0 dated Jan. 9, 2017, 10 pages.

(Continued)

*Primary Examiner* — Cristi J Tate-Sims

(74) *Attorney, Agent, or Firm* — Fish & Richardson P.C.

(57) ABSTRACT

A laundry treating apparatus includes a cabinet. The laundry treating apparatus further includes a drawer provided to be ejected from the cabinet. The laundry treating apparatus further includes a tub provided inside the drawer, providing a space where water is stored. The laundry treating apparatus further includes a drum rotatably provided inside the tub, providing a space where laundry is stored. The laundry treating apparatus further includes an inlet provided in the tub, inserting laundry into the drum. The laundry treating apparatus further includes a support unit provided between the tub and drum to prevent one surface of the tub having the inlet from being bent toward the drum and ejected to the outside of the tub through the inlet.

14 Claims, 5 Drawing Sheets

(56) References Cited

U.S. PATENT DOCUMENTS

| | | | | |
|---|---|---|---|---|
| 9,580,855 | B2 * | 2/2017 | Kim | B65D 81/02 |
| 2009/0139275 | A1 | 6/2009 | Kim et al. | |
| 2013/0036773 | A1 * | 2/2013 | Choi | D06F 37/40 68/140 |
| 2015/0059418 | A1 | 3/2015 | Lee et al. | |

FOREIGN PATENT DOCUMENTS

| | | | | |
|---|---|---|---|---|
| CN | 104250906 | | 12/2014 | |
| CN | 104342879 | | 2/2015 | |
| CN | 104420122 | | 3/2015 | |
| CN | 104611887 | | 5/2015 | |
| JP | H06-156573 | | 6/1994 | |
| KR | 20-1999-0005477 | | 2/1999 | |
| KR | 10-2000-0002173 | | 1/2000 | |
| KR | 10-0751760 | | 8/2007 | |
| KR | 10-2008-0011603 | | 2/2008 | |
| WO | WO-2010040658 | A1 * | 4/2010 | D06F 39/001 |
| WO | 2012/150539 | | 11/2012 | |

OTHER PUBLICATIONS

International Search Report and Written Opinion in International Application No. PCT/KR2016/009805, dated Nov. 18, 2016, 12 pages.

Chinese Office Action in Chinese Application No. 201610801705.2, dated Jun. 5 2018, 15 pages.

Chinese Office Action in Chinese Application No. 201610801705.2, dated Sep. 12, 2019, 18 pages (with English translation).

* cited by examiner

【fig 1】
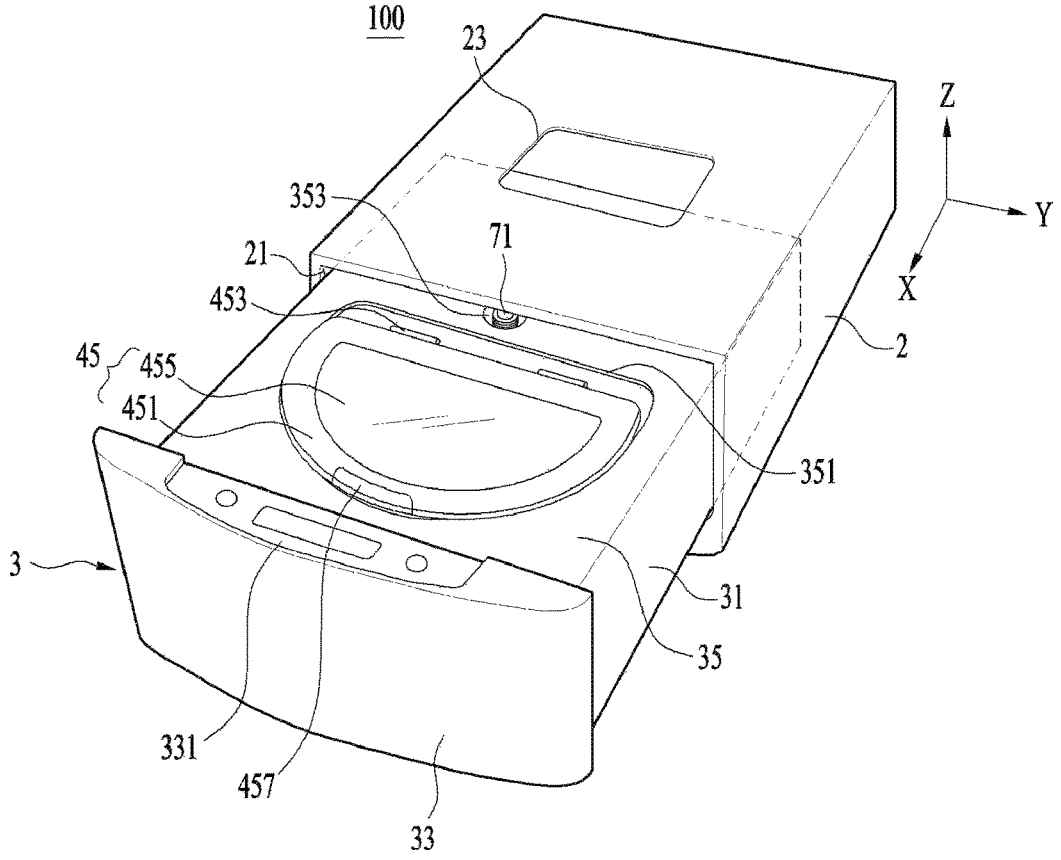

【fig 2】
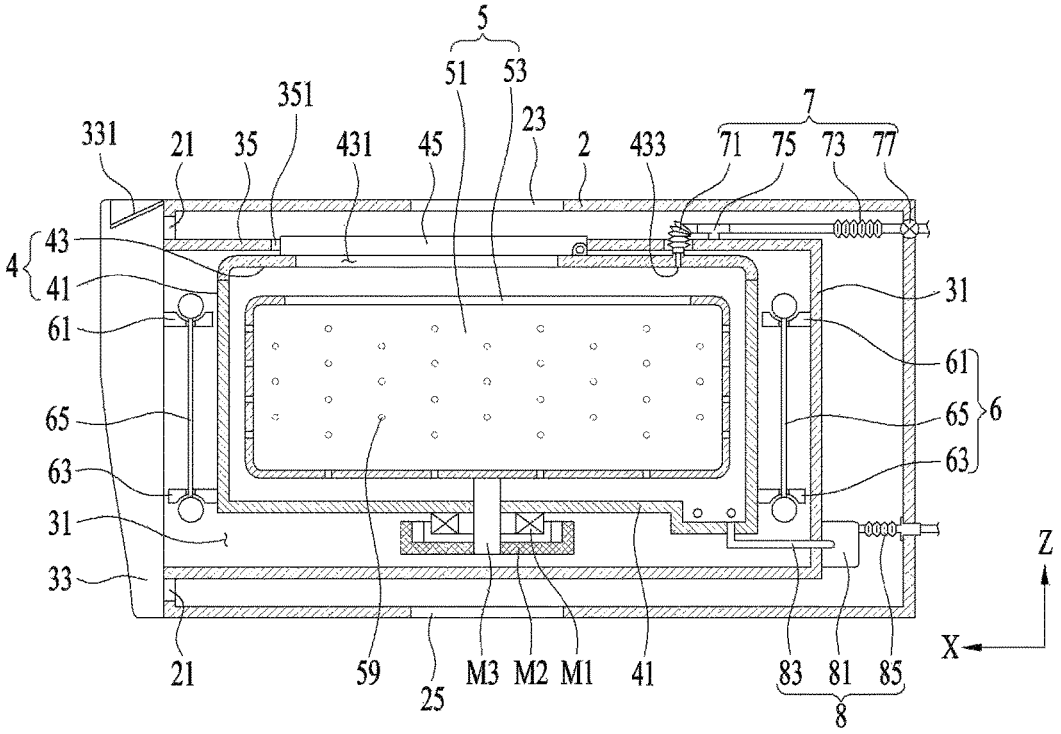

【fig 3】
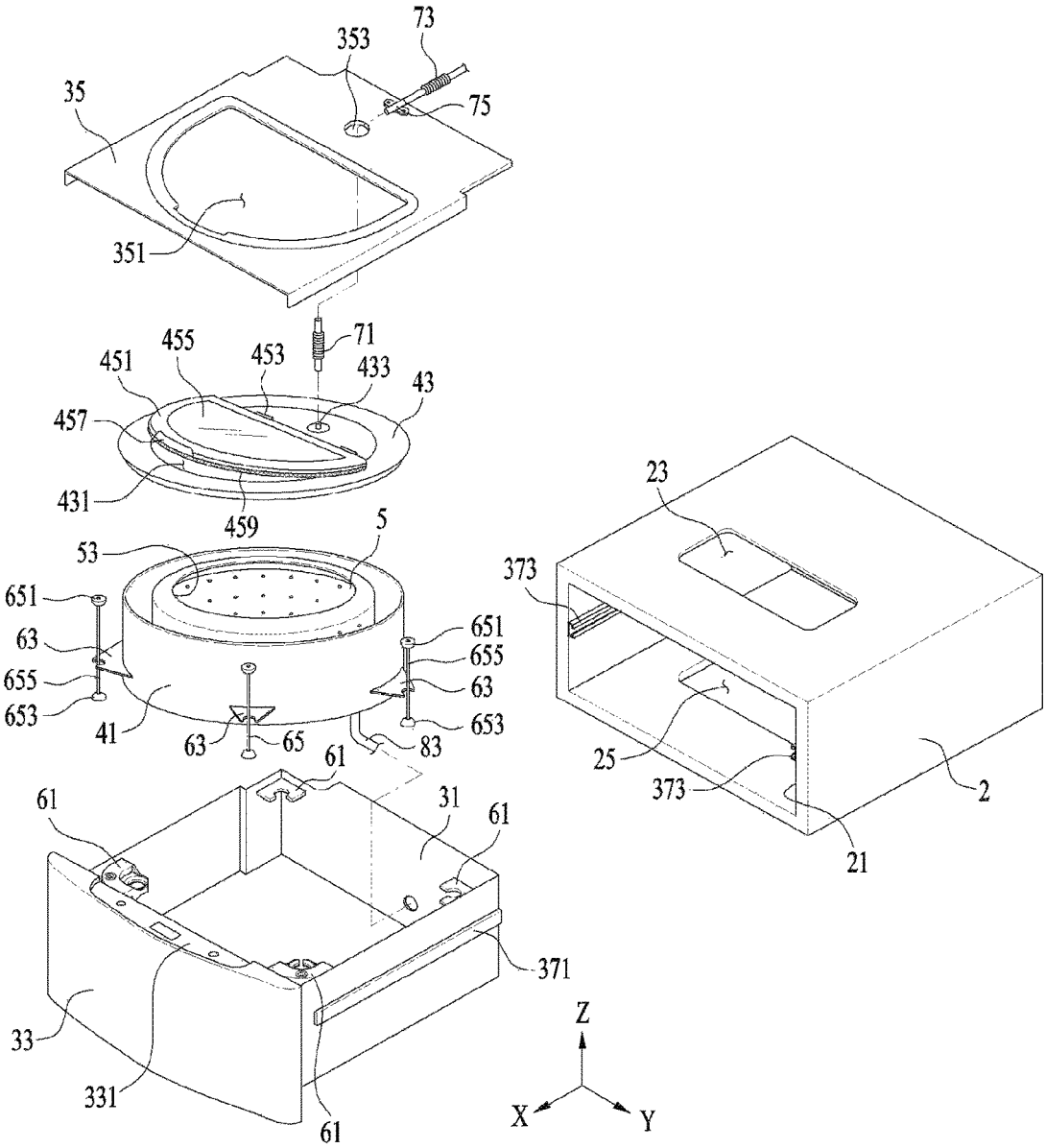

【fig 4】
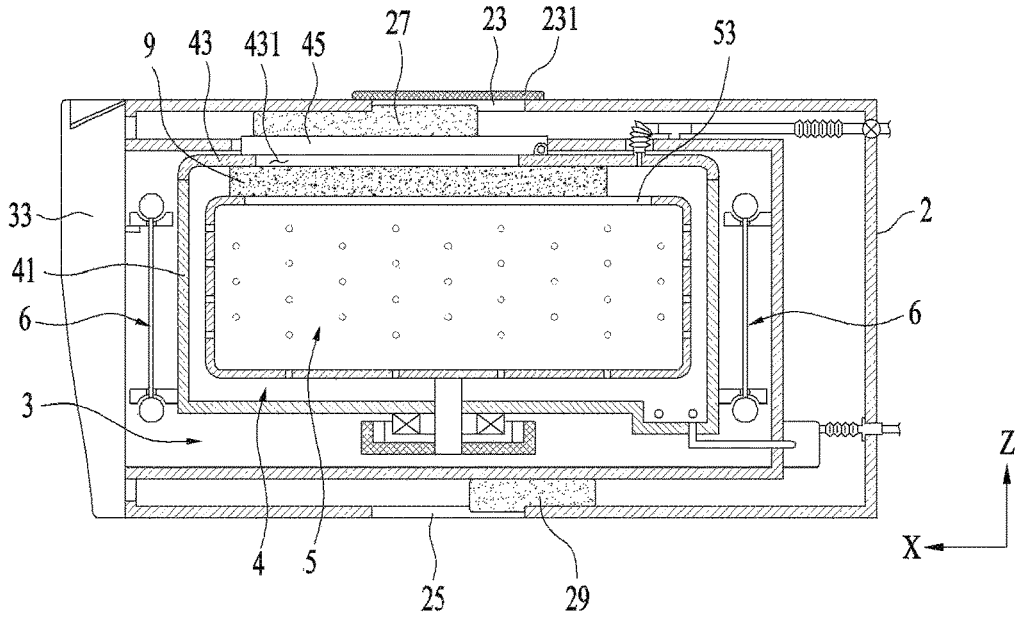
【fig 5】
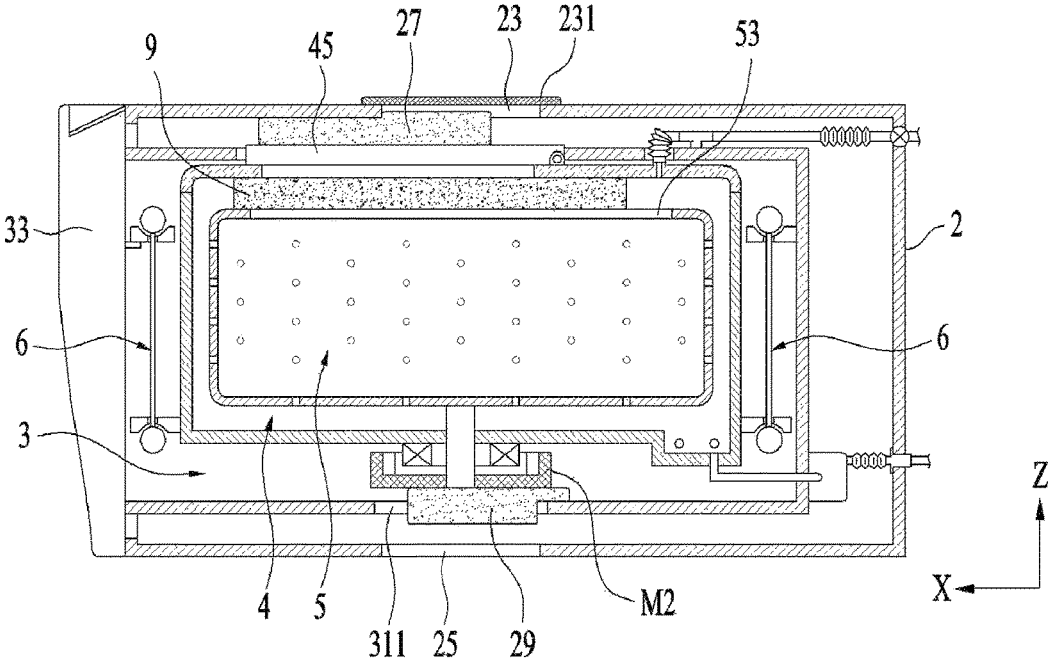

【fig 6】
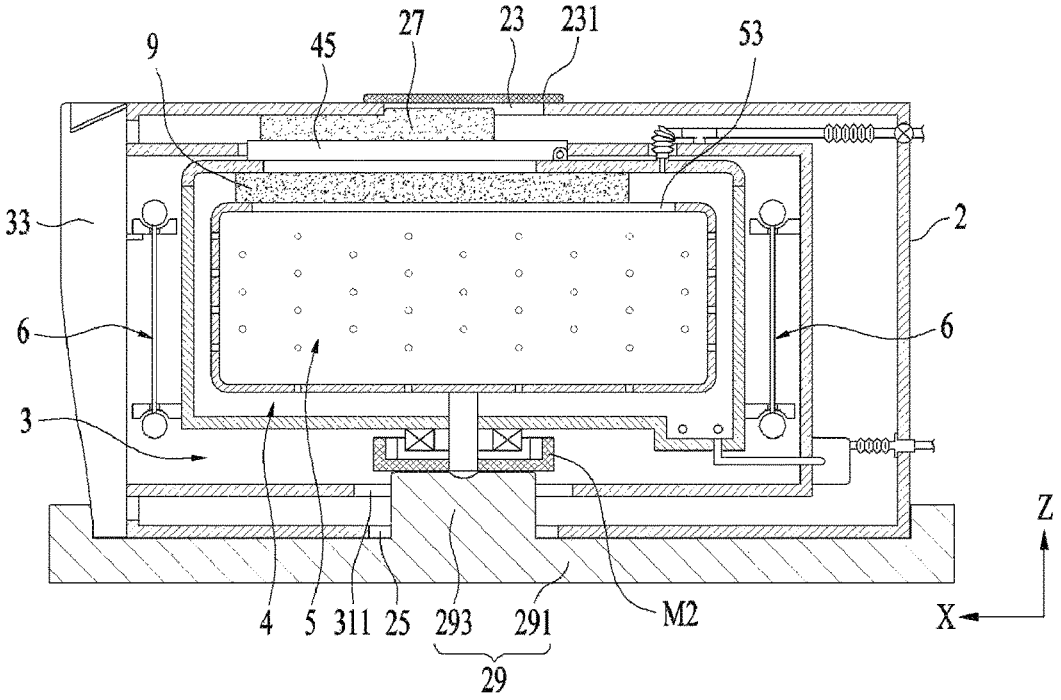

LAUNDRY TREATING APPARATUS

This application claims the benefit of the Korean Patent Application No. 10-2015-0136397, filed on Sep. 25, 2015, which is hereby incorporated by reference as if fully set forth herein.

FIELD

The present disclosure relates to a laundry treating apparatus.

BACKGROUND

Generally, a laundry treating apparatus includes an apparatus for washing laundry (laundry for washing or laundry for drying), an apparatus for drying laundry, and an apparatus for performing both washing and drying laundry.

A laundry treating apparatus of the related art has been categorized into a front loading type laundry treating apparatus having a laundry inlet provided on a front surface to load laundry therein and a top loading type laundry treating apparatus having a laundry inlet provided on an upper surface to load laundry therein.

The top loading type laundry treating apparatus includes a cabinet, a drawer to be ejected from the cabinet, a tub provided in the drawer, having an inlet on an upper surface, a drum rotatably provided inside the tub, and a door opening or closing the inlet.

SUMMARY

According to an innovative aspect of the subject matter described in this application, a laundry treating apparatus includes a cabinet; a drawer provided to be ejected from the cabinet; a tub provided inside the drawer, providing a space where water is stored; a drum rotatably provided inside the tub, providing a space where laundry is stored; an inlet provided in the tub, inserting laundry into the drum; and a support unit provided between the tub and drum to prevent one surface of the tub having the inlet from being bent toward the drum and ejected to the outside of the tub through the inlet.

This and other implementations may include one or more of the following optional features. The tub includes a tub body that is configured to receive water, and a tub cover that defines an upper surface of the tub and that defines the inlet. The drum includes a drum body that is configured to receive laundry. The drum defines a drum inlet that is located below the inlet and that is configured to receive laundry. The tub support unit is located between the tub cover and the drum inlet. The support unit includes rubber. The support unit includes a porous material. The laundry treating apparatus further includes a spacer that is configured to prevent the drawer from colliding with the cabinet. The laundry treatment apparatus further includes a spacer that is configured to maintain the drawer inside cabinet. The spacer includes rubber. The spacer includes a porous material. The spacer includes a first spacer that is located in a space between the cabinet and an upper surface of the drawer. An upper surface of the cabinet defines an upper through hole that is configured to receive the first spacer. The first spacer is configured to maintain a position in the space between the cabinet and the upper surface of the drawer based on friction.

The spacer includes a second spacer that is located in a space between the cabinet and a bottom surface of the drawer. A bottom surface of the cabinet defines a lower through hole that is configured to receive the second spacer. The second spacer is configured to maintain a position in the space between the cabinet and the bottom surface of the drawer based on friction. The laundry treating apparatus further includes a stator that is connected to a bottom surface of the tub and that is configured to generate a rotating field; a rotor that is configured to rotate based on the rotating field; a rotational shaft that connects the rotor with the drum and that passes through the bottom surface of the tub; and a second spacer that is located in a space between the rotor and the drawer. A bottom surface of the cabinet defines a lower through hole that is configured to receive the second spacer. The bottom surface of the drawer defines a drawer through hole that is configured to receive the second spacer.

The laundry treating apparatus further includes a stator that is connected to a bottom surface of the tub and that is configured to generate a rotating field; a rotor that is configured to rotate based on the rotating field; a rotational shaft that connects the rotor with the drum and that passes through the bottom surface of the tub; and a second spacer that includes a support body that is configured to support a bottom surface of the cabinet; and a fixing body that is configured to support the rotor and that is located on the support body. The bottom surface of the cabinet defines a lower through hole that is configured to receive the fixing body. The bottom surface of the drawer defines a drawer through hole that is configured to receive the fixing body. The support body is larger than the bottom surface of the cabinet. A length of the drawer is greater than a height of the drawer. The length of the drawer is measured along an axis that is parallel to a direction that the drawer is removed from the cabinet. The height of the drawer is measured along an axis that is parallel to an axis of rotation of the drum. A thickness of the tub support unit is equal to a distance between the tub cover and the drum inlet. A thickness of the tub support unit is greater than a distance between the tub cover and the drum inlet.

An object of the subject matter described in this application is to provide a laundry treating apparatus that prevents a drawer from colliding with a cabinet or prevents the drawer from being ejected from the cabinet during transportation of the laundry treating apparatus.

Another object of the subject matter described in this application is to provide a laundry treating apparatus that prevents an upper surface of a tub from being bent toward a drum.

BRIEF DESCRIPTION OF THE DRAWINGS

FIG. 1 is a perspective view of an example laundry treating apparatus.

FIG. 2 is a cross sectional view of an example laundry treatment apparatus.

FIG. 3 is an exploded view of an example laundry treatment apparatus.

FIGS. 4, 5, and 6 illustrate example support units and example spacers in laundry treatment apparatuses.

DETAILED DESCRIPTION

As shown in FIG. 1, a laundry treating apparatus includes a cabinet 2, a drawer 3 provided to be ejected from the cabinet 2, a tub 4 (see FIG. 2) provided inside the drawer, storing water therein, and a drum 5 (see FIG. 2) rotatably provided inside the tub, storing laundry therein.

The cabinet 2 may be provided as a means for forming external appearance of the laundry treating apparatus, or may be provided as a space for receiving the drawer 3. In some implementations, an opened surface 20, into which the drawer 3 is inserted, is provided on a front surface of the cabinet 2.

The drawer 3 includes a drawer body 31 inserted into the cabinet 2 through the opened surface 21, a drawer panel 33 fixed to a front surface of the drawer body 31, opening or closing the opened surface 21, and a drawer cover 35 forming an upper surface of the drawer body 31.

Since the drawer panel 33 is fixed to the front surface of the drawer body 31, the drawer panel 33 may serve as a handle that ejects the drawer body 31 from the cabinet 2.

The drawer panel 33 may be provided with a control panel 331 for inputting a control command related to an operation of the laundry treating apparatus 100 and displaying a message related to the operation of the laundry treating apparatus 100 to a user.

The drawer body 31 may be inserted into the cabinet 2 through the opened surface 21, and may be provided in any shape as far as the drawer body 31 may provide a space for receiving the tub 4. FIG. 1 illustrates an example of the drawer body 31 of a hexahedral shape, of which inner part is empty.

The drawer 3 may be ejected from the cabinet 2 by a drawer guider that includes a slider 371 fixed to a side of the drawer body 31 and a slider receiving portion 373 provided inside the cabinet 2, receiving the slider 371 (see FIG. 3).

The drawer cover 35 is provided with a first through hole 351 and a second through hole 353, which communicate the inside of the drawer body 31 with the outside of the drawer body 31. The first through hole 351 is provided to insertion and ejection of laundry while the second through hole 353 is provided to supply water required for washing of laundry, and their detailed description will be described later.

As shown in FIG. 2, the tub 4 includes a tub body 41 located inside the drawer body 31, storing water therein, and a tub cover 43 forming an upper surface of the tub body 41. The tub body 41 may be provided in a cylindrical shape of which upper surface is opened.

The tub cover 43 may include an inlet 431 communicating the inside of the tub body 41 with the outside of the tub body 41, and a supply opening 433 flowing water into the tub body 41.

In some implementations, the inlet 431 is provided to communicate with the first through hole 351 provided in the drawer cover 35, and the supply opening 433 is provided to communicate with the second through hole 353 of the drawer cover. In some implementations, the inlet 431 is located below the first through hole 351, and the supply opening 433 is located below the second through hole 353.

The inlet 431 is a means for supplying laundry into the tub body 41 or ejecting laundry inside the tub body 41 to the outside of the tub body 41, and is opened or closed by a door 45.

As shown in FIG. 3, the door 45 may include a frame 451 rotatably coupled to the tub cover 43 through a hinge 453, a window 455 provided in the frame 451, and a door handle 457 detachably coupling the frame 451 to the tub cover 43. In some implementations, the window 455 is made of a transparent material to allow a user to identify the inside of the tub body 41.

The drum 5 provided inside the tub 4 may be provided to include a drum body 51 of a cylindrical shape and a drum inlet 53 provided in the drum body 51.

Since the drum inlet 53 is located below the inlet 431, laundry supplied through the inlet 431 may be supplied to the drum body 51 through the drum inlet 53.

As shown in FIG. 2, a plurality of drum through holes 59 communicating the inside of the drum body 51 with the tub body 41 may be provided on a bottom surface 57 and a circumferential surface 55 of the drum body 51.

The drum body 51 is rotated inside the tub body 41 by a driving unit. The driving unit includes a stator M1 located outside the tub body 41 and fixed to the bottom surface of the tub body. The driving unit also includes a rotor M2 rotated by a rotating field provided by the stator, and a rotational shaft M3 provided to pass through the bottom surface of the tub body 41, connecting the bottom surface of the drum body with the rotor M2. In this case, the rotational shaft M3 may be provided to be orthogonal to the bottom surface of the tub body 41.

The tub 4 having the aforementioned structure is coupled to the drawer body 31 through a tub support unit 6. The tub support unit 6 may include a first support unit 61 provided in the drawer body 31, a second support unit 63 provided in the tub body 41, and a connecting unit 65 connecting the first support unit 61 with the second support unit 63.

As shown in FIG. 3, the connecting unit 65 may include a first connecting unit 651 mounted inside the first support unit 61, a second connecting unit 653 supporting the second support unit 63, and a bar 655 connecting the first connecting unit 651 with the second connecting unit 653.

The first connecting unit 651 may be provided in a shape that may move inside the first support unit 61 while being mounted inside the first support unit 61, and the second connecting unit 653 may be provided in a shape that may move inside the second support unit 63 while supporting the second support unit 63.

The laundry treating apparatus 100 having the aforementioned structure supplies water to the tub 4 through a water supply unit 7, and discharges water stored in the tub 4 to the outside of the cabinet 2 through a drainage unit 8.

The water supply unit 7 may include a first water supply pipe 71 connected to the supply opening 433 provided in the tub cover, a second water supply pipe 73 connected with a water supply source located outside the cabinet, and a connecting pipe 75 fixed to the tub cover 43, connecting the first water supply pipe 71 with the second water supply pipe 73.

The first water supply pipe 71 connects the supply opening 433 with the connecting pipe 75 through the second through hole 353 provided in the drawer cover 35, and may be provided as a corrugated pipe to be prevented from being detached from the connecting pipe 75 during vibration of the tub 4 (see FIG. 3).

In addition, the second water supply pipe 73 may also be provided as a corrugated pipe to be prevented from being detached from the connecting pipe 75 when the drawer 3 is ejected from the cabinet 2. The second water supply pipe 73 is opened or closed by a water supply valve 77 controlled by a controller.

However, unlike FIG. 2, the water supply unit 7 may be provided with one water supply pipe connecting a water supply source located outside the cabinet with the supply opening 433 provided in the tub cover. In some implementations, the water supply pipe is provided as a corrugated pipe.

The drainage unit 8 may be provided with a drainage pump 81 fixed to the drawer body 31, a first drainage pipe 83 guiding water inside the tub body 41 to the drainage pump 81, and a second drainage pipe 85 guiding water discharged from the drainage pump 81 to the outside of the cabinet 2. In this case, the second drainage pipe 85 may be provided as a corrugated pipe.

In the laundry treating apparatus 100, since the drawer 3 may be ejected from the cabinet 2, it is required to prevent the drawer 3 from colliding with the cabinet 2 and prevent the drawer 3 from being ejected from the cabinet 3 during transportation of the laundry treating apparatus 100.

To prevent the drawer 3 from being ejected from the cabinet 2 and prevent the drawer 3 from colliding with the cabinet 2 during transportation of the laundry treating apparatus, the laundry treating apparatus may further include a detachable spacer on a space between the drawer 3 and the cabinet 2.

The spacer may be provided to include at least one of a first spacer located on a space between the upper surface of the drawer 3 and the cabinet 2 and a second spacer located on a space between the bottom surface of the drawer 3 and the cabinet 2.

In some implementations, the first spacer and the second spacer are subjected to interference fit or tight fit on the space between the drawer 3 and the cabinet 2. In these implementations, the first spacer and the second spacer fix the drawer 3 to the cabinet 2 during transportation of the laundry treating apparatus but discharge the drawer 3 to the outside of the cabinet 2 through a through hole provided in each of the upper and lower surfaces of the cabinet once transportation of the laundry treating apparatus is completed.

In some implementations and in the laundry treating apparatus 100, since the tub 4 is supported inside the drawer 3 through the tub support unit 6, it is required to prevent the drawer 3 from being ejected from the cabinet 2 and prevent the tub 4 from colliding with the drawer 3 during transportation of the laundry treating apparatus 100.

To this end, the first spacer may be provided to prevent the tub 4 from colliding with the drawer 3 during transportation of the laundry treating apparatus 100, and the second spacer may be provided to prevent the drawer 3 from being ejected from the cabinet 2 during transportation of the laundry treating apparatus.

That is, as shown in FIG. 4, the first spacer 27 may be provided to maintain an interval between the cabinet 2 and the door 45. The first spacer 27 may detachably be provided on the space between the cabinet 2 and the door 45 through an upper through hole 23. That is, the first spacer 27 may be provided to be detached from the space between the cabinet 2 and the door 45. The upper through hole 23 is provided to pass through the upper surface of the cabinet.

In some implementations, the second spacer 29 may be provided to maintain an interval between the cabinet 2 and the bottom surface of the drawer 3. The second spacer 29 may detachably be provided on the space between the cabinet 2 and the bottom surface of the drawer 3 through a lower through hole 25. That is, the second spacer 29 may be provided to be detached from the space between the cabinet 2 and the bottom surface of the drawer 3. The lower through hole 25 is provided to pass through the bottom surface of the cabinet 2.

The first spacer 27 may be made of any material as far as the interval between the cabinet 2 and the door 45 may be maintained. As an example, the first spacer 27 may be made of a porous material such as sponge or an elastic body such as rubber.

The first spacer 27 may be tightly fitted to the space formed between the upper surface of the door 45 and the cabinet 2, and may be inserted into the cabinet 2 through the upper through hole 23 or may be ejected from the inside of the cabinet 2 to the outside of the cabinet 2 through the upper through hole 23.

The second spacer 29 may also be made of a material such as sponge or rubber, and may be tightly fitted into the space between the bottom surface of the drawer 3 and the cabinet 2.

The second spacer 29 may be inserted from the outside of the cabinet 2 to the inside of the cabinet 2 or ejected from the inside of the cabinet 2 to the outside of the cabinet 2 through the lower through hole 25 provided on the bottom surface of the cabinet 2.

FIGS. 5 and 6 illustrate example support units and example spacers including example second spacers. The second spacer 29 of FIG. 5 is inserted into the space between the rotor M2 and the bottom surface of the drawer 3 to prevent the tub 4 from moving inside the drawer 3 during transportation of the laundry treating apparatus.

That is, the laundry treating apparatus of FIG. 5 further includes a drawer through unit 311 provided to pass through the bottom surface of the drawer 3 and located below the rotor M2. The second spacer 29 may be tightly fitted into the space between the rotor M2 and the bottom surface of the drawer 3 through the lower through hole 25 and the drawer through unit 311.

In some implementations, for example, FIG. 6, the second spacer 29 includes a support body 291 supporting the bottom surface of the cabinet 2, and a fixing body 293 protruded from the support body 291 to support the rotor M2 and therefore minimize movement of the tub 4.

The support body 291 may be provided to support the bottom surface of the cabinet 2, that is, the entire bottom surface of the laundry treating apparatus, and the fixing body 293 is inserted into the lower through hole 25 and the drawer through unit 311 to support the rotor M2. In some implementations, once the laundry treating apparatus 100 is mounted on the support body 291, the tub 4 may be prevented from moving inside the drawer 3 during transportation of the laundry treating apparatus 100.

In some implementations, the drawer through unit 311 may be provided as a hole that passes through the bottom surface of the drawer 3. However, if the bottom surface of the drawer 3 is opened, the opened bottom surface of the drawer 3 may be the drawer through unit 311.

Although the aforementioned spacers 27 and 29 may prevent the drawer 3 from being ejected from the cabinet 2 or prevent the tub 4 from colliding with the drawer 3 during transportation of the laundry treating apparatus 100 or when an external force is input to the laundry treating apparatus 100, the tub cover 43 may be deformed.

It is general that each of the tub body 41 and the tub cover 43 is made of a plastic material. If the laundry treating apparatus moves to a long distance through a transportation means such as a ship, the tub may be subjected to plastic deformation depending on a transportation status.

If the tub 4 is exposed to an external force or heat, it is likely that plastic deformation may occur in the tub cover 43. This is because that the tub cover 43 is more vulnerable to the external force than the other area of the tub because the tub cover 43 is provided with the inlet 431 and that the tub cover is likely to be bent due to a weight of the door 45 provided in the inlet 431.

Also, since the second spacer 29 pressurizes the drawer 3 toward the upper surface of the cabinet and the first spacer 27 pressurizes the tub cover 43 toward the lower surface of the cabinet, the first spacer 27 and the second spacer 29 may be factors that aggravate deformation of the tub cover 43. That is, the first spacer and the second spacer may aggravate deformation that the tub cover 43 is bent toward the drum 5.

If the tub cover 43 is bent toward the drum 5, a problem may occur in that the drum 5 interferes with the tub cover 43 and therefore fails to be rotated. The laundry treating apparatus is characterized in that a height (z-axis direction length of the cabinet) of the cabinet 2 is smaller than a depth (x-axis direction length of the cabinet) of the cabinet 2. In this case, since a height of the drawer 3 provided inside the cabinet is also smaller than its depth (drawer length parallel with a direction that the drawer is ejected), the interval between the tub cover 43 and the upper end (surface where the inlet is provided) of the drum should become narrow to increase volumes of the tub 4 and the drum 5 (to increased washing capacity). It is very important to prevent the tub cover 43 from being bent in the laundry treating apparatus in which the interval between the tub cover 43 and the upper end of the drum 5 is narrow.

To this end, the laundry treating apparatus 100 may further include a tub support unit 9 for preventing one surface 43 of the tub having the inlet 431 from being bent toward the drum 5.

The tub support unit 9 may be provided to be ejected to the outside of the tub body 41 through the inlet 431 provided in the tub cover. This is to allow an installation worker to remove the tub support unit 9 after transportation of the laundry treating apparatus 100 is completed. FIGS. 4 to 6 illustrate that the tub support unit 9 may be provided between the tub cover 43 and the drum inlet 53.

The tub support unit 9 may be made of any shape or any material as far as the interval between the tub 4 and the drum 5 may be maintained uniformly. As an example, the tub support unit 9 may be made of an elastic body such as rubber or a porous material such as sponge.

What is claimed is:

1. A laundry treating apparatus comprising:

a cabinet;

a drawer provided to be ejected from the cabinet;

a tub provided inside the drawer, providing a space where water is stored;

a tub cover provided at an upper surface of the tub and including an inlet to insert laundry;

a drum rotatably provided inside the tub, defining a space where laundry is stored, and including a drum inlet to insert laundry into the drum; and a support unit (i) provided with a thickness corresponding to a distance between the drum and the tub cover, (ii) including a lower end that is seated in the drum inlet and an upper end that supports the tub cover, (iii) fitted between the tub cover and the drum to prevent the tub cover from deforming based on the laundry treating apparatus being transported, (iv) that is a size of an area of the inlet of the tub cover, and (v) configured to be inserted or ejected through the inlet of the tub cover.

2. The laundry treating apparatus according to claim 1, further comprising a spacer that is configured to prevent the drawer from colliding with the cabinet.

3. The laundry treatment apparatus according to claim 1, further comprising a spacer that is configured to maintain the drawer inside cabinet.

4. The laundry treatment apparatus according to claim 2, wherein the spacer comprises rubber.

5. The laundry treatment apparatus according to claim 2, wherein the spacer comprises a porous material.

6. The laundry treating apparatus according to claim 2, wherein:

the spacer includes a first spacer that is located in a space between the cabinet and an upper surface of the drawer, and an upper surface of the cabinet defines an upper through hole that is configured to receive the first spacer.

7. The laundry treating apparatus according to claim 6, wherein the first spacer is configured to maintain a position in the space between the cabinet and the upper surface of the drawer based on friction.

8. The laundry treating apparatus according to claim 6, wherein:

the spacer includes a second spacer that is located in a space between the cabinet and a bottom surface of the drawer, and a bottom surface of the cabinet defines a lower through hole that is configured to receive the second spacer.

9. The laundry treating apparatus according to claim 8, wherein the second spacer is configured to maintain a position in the space between the cabinet and the bottom surface of the drawer based on friction.

10. The laundry treating apparatus according to claim 6, further comprising:

a stator that is connected to a bottom surface of the tub and that is configured to generate a rotating field;

a rotor that is configured to rotate based on the rotating field;

a rotational shaft that connects the rotor with the drum and that passes through the bottom surface of the tub; and a second spacer that is located in a space between the rotor and the drawer, wherein a bottom surface of the cabinet defines a lower through hole that is configured to receive the second spacer, and wherein the bottom surface of the drawer defines a drawer through hole that is configured to receive the second spacer.

11. The laundry treating apparatus according to claim 6, further comprising:

a stator that is connected to a bottom surface of the tub and that is configured to generate a rotating field;

a rotor that is configured to rotate based on the rotating field;

a rotational shaft that connects the rotor with the drum and that passes through the bottom surface of the tub; and a second spacer that includes:

a support body that is configured to support a bottom surface of the cabinet; and a fixing body that is configured to support the rotor and that is located on the support body, wherein the bottom surface of the cabinet defines a lower through hole that is configured to receive the fixing body, and wherein the bottom surface of the drawer defines a drawer through hole that is configured to receive the fixing body.

12. The laundry treating apparatus according to claim 11, wherein the support body is larger than the bottom surface of the cabinet.

13. The laundry treating apparatus according to claim 1, wherein:

a length of the drawer is greater than a height of the drawer, the length of the drawer is measured along an axis that is parallel to a direction that the drawer is removed from the cabinet, and the height of the drawer is measured along an axis that is parallel to an axis of rotation of the drum.

14. The laundry treating apparatus according to claim 1, wherein a thickness of the support unit is greater than a distance between the tub cover and the drum inlet.

* * * * *